US006082790A

United States Patent [19]

Mossotti et al.

[11] Patent Number: 6,082,790

[45] Date of Patent: Jul. 4, 2000

[54] DOOR ANTI-LOCKING DEVICE

[76] Inventors: John F. Mossotti; Daniel W. Nicolini, both of P.O. Box 292, Solvay, N.Y. 13209

[21] Appl. No.: 09/335,171

[22] Filed: Jun. 17, 1999

[51] Int. Cl.[7] ..... E05B 15/02

[52] U.S. Cl. ..... 292/341.14; 292/1; 292/289

[58] Field of Search ..... 292/341.14, 1, 292/203, 204, 202, DIG. 35, 289, 297; 70/416–418

[56] References Cited

U.S. PATENT DOCUMENTS

| | | | |
|---|---|---|---|
| 382,086 | 5/1888 | Herrick | 292/DIG. 35 |
| 1,383,582 | 7/1921 | Stubbs . | |
| 1,765,614 | 6/1930 | Roberts | 292/DIG. 35 |
| 2,595,436 | 5/1952 | Abdallah | 292/204 |
| 2,727,892 | 12/1955 | Zynda | 292/341.14 |
| 2,973,985 | 3/1961 | Siegal | 292/204 |
| 3,951,444 | 4/1976 | Shull | 292/204 |

*Primary Examiner*—B. Dayoan
*Assistant Examiner*—Gary Estremsky

[57] ABSTRACT

A door anti-locking device for preventing a door lock bolt engaging a strike plate in the door frame to prevent locking of the door. The door anti-locking device includes a cover plate having inwards and outwards faces, a pair of ends and a pair of sides extending between the ends of the cover plate. The cover plate has a pivot hole extending therethrough between the faces of the cover plate. The pivot hole is positioned towards a first of the ends of the cover plate. The pivot hole is designed for extending a threaded fastener therethrough an into a strike plate to pivotally couple the cover plate to the strike plate.

5 Claims, 2 Drawing Sheets

DOOR ANTI-LOCKING DEVICE

BACKGROUND OF THE INVENTION

1. Field of the Invention

The present invention relates to door anti-locking devices and more particularly pertains to a new door anti-locking device for preventing a door lock bolt engaging a strike plate in the door frame to prevent locking of the door.

2. Description of the Prior Art

The use of door anti-locking devices is known in the prior art. More specifically, door anti-locking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 543,908; 2,492,322; 4,159,838; 4,189,176; 987,271; and U.S. Pat. No. Des. 352,224 which are all herein incorporated by reference to the extent necessary to understand the present invention.

While these devices fulfill their respective, particular objectives and requirements, the aforementioned patents do not disclose a new door anti-locking device. The inventive device includes a cover plate having inwards and outwards faces, a pair of ends and a pair of sides extending between the ends of the cover plate. The cover plate has a pivot hole extending therethrough between the faces of the cover plate. The pivot hole is positioned towards a first of the ends of the cover plate. The pivot hole is designed for extending a threaded fastener therethrough an into a strike plate to pivotally couple the cover plate to the strike plate.

In these respects, the door anti-locking device according to the present invention substantially departs from the conventional concepts and designs of the prior art, and in so doing provides an apparatus primarily developed for the purpose of preventing a door lock bolt engaging a strike plate in the door frame to prevent locking of the door.

SUMMARY OF THE INVENTION

In view of the foregoing disadvantages inherent in the known types of door anti-locking devices now present in the prior art, the present invention provides a new door anti-locking device construction wherein the same can be utilized for preventing a door lock bolt engaging a strike plate in the door frame to prevent locking of the door.

The general purpose of the present invention, which will be described subsequently in greater detail, is to provide a new door anti-locking device apparatus and method which has many of the advantages of the door anti-locking devices mentioned heretofore and many novel features that result in a new door anti-locking device which is not anticipated, rendered obvious, suggested, or even implied by any of the prior art door anti-locking devices, either alone or in any combination thereof.

To attain this, the present invention generally comprises a cover plate having inwards and outwards faces, a pair of ends and a pair of sides extending between the ends of the cover plate. The cover plate has a pivot hole extending therethrough between the faces of the cover plate. The pivot hole is positioned towards a first of the ends of the cover plate. The pivot hole is designed for extending a threaded fastener therethrough and into a strike plate to pivotally couple the cover plate to the strike plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door anti-locking device apparatus and method which has many of the advantages of the door anti-locking devices mentioned heretofore and many novel features that result in a new door anti-locking device which is not anticipated, rendered obvious, suggested, or even implied by any of the prior art door anti-locking devices, either alone or in any combination thereof.

It is another object of the present invention to provide a new door anti-locking device which may be easily and efficiently manufactured and marketed.

It is a further object of the present invention to provide a new door anti-locking device which is of a durable and reliable construction.

An even further object of the present invention is to provide a new door anti-locking device which is susceptible of a low cost of manufacture with regard to both materials and labor, and which accordingly is then susceptible of low prices of sale to the consuming public, thereby making such door anti-locking device economically available to the buying public.

Still yet another object of the present invention is to provide a new door anti-locking device which provides in the apparatuses and methods of the prior art some of the advantages thereof, while simultaneously overcoming some of the disadvantages normally associated therewith.

Still another object of the present invention is to provide a new door anti-locking device for preventing a door lock bolt engaging a strike plate in the door frame to prevent locking of the door.

Yet another object of the present invention is to provide a new door anti-locking device which includes a cover plate having inwards and outwards faces, a pair of ends and a pair of sides extending between the ends of the cover plate. The cover plate has a pivot hole extending therethrough between the faces of the cover plate. The pivot hole is positioned towards a first of the ends of the cover plate. The pivot hole is designed for extending a threaded fastener therethrough an into a strike plate to pivotally couple the cover plate to the strike plate.

Still yet another object of the present invention is to provide a new door anti-locking device that is easy to install into and existing door frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
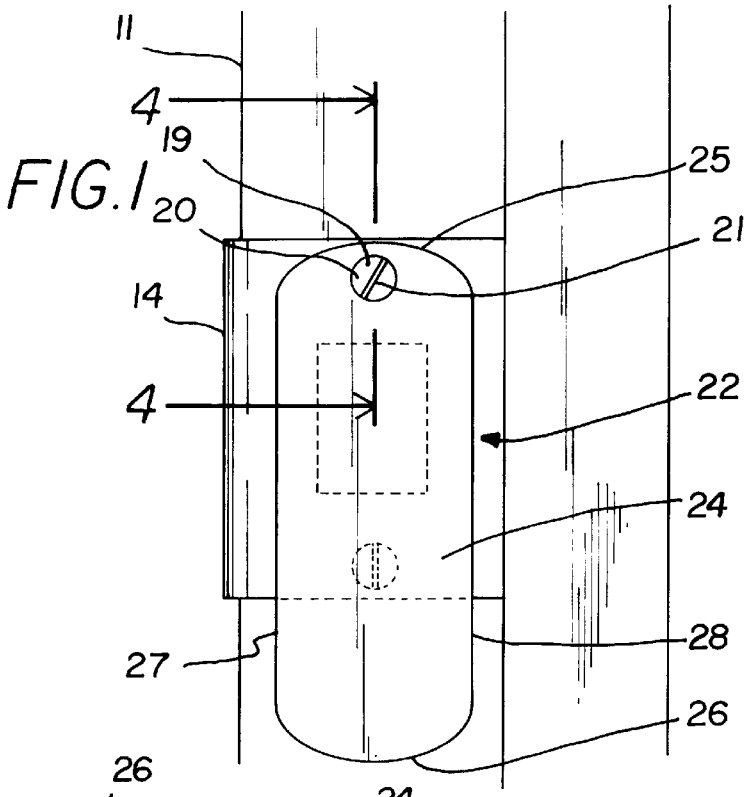
FIG. 1 is a schematic plan view of a new door anti-locking device with the cover plate in the lowered covered position.

With reference now to the drawings, and in particular to FIGS. 1 through 4 thereof, a new door anti-locking device embodying the principles and concepts of the present invention will be described.

As best illustrated in FIGS. 1 through 4, the door anti-locking device generally comprises a cover plate having inwards and outwards faces, a pair of ends and a pair of sides extending between the ends of the cover plate. The cover plate has a pivot hole extending therethrough between the faces of the cover plate. The pivot hole is positioned towards a first of the ends of the cover plate. The pivot hole is designed for extending a threaded fastener therethrough an into a strike plate to pivotally couple the cover plate to the strike plate.

In closer detail, the present invention is designed a part of a system including a door 10 pivotally coupled to a door frame 11. The door has a door lock 12 with a retractable bolt 13 outwardly extending from the door.

The door frame has a strike plate 14 coupled thereto. The strike plate has a generally rectangular central hole 15 therethrough aligned with a corresponding receiver hole 16 in the door jamb for receiving therein the bolt of the door lock when the door is closed. The strike plate also has spaced apart upper and lower mounting holes 17,18. The central hole is interposed between the mounting holes of the strike plate.

Figure 4:
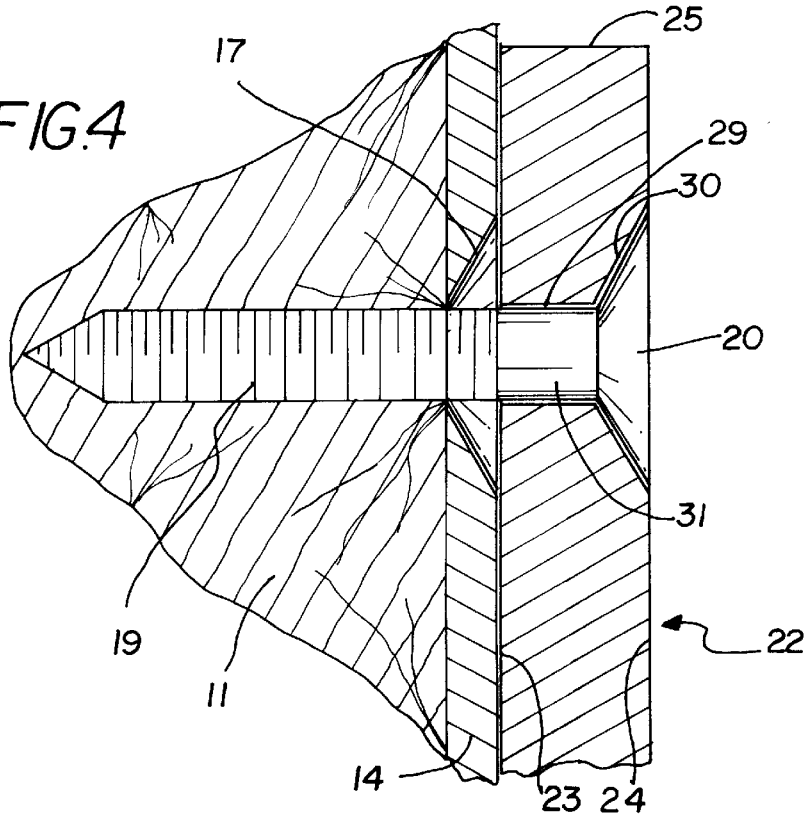
FIG. 4 is a schematic cross sectional view taken from line 4—4 of FIG. 1.

As best illustrated in FIG. 4, the upper and lower mounting holes of the strike plate each may have a generally frusta-conical shaped outer periphery tapering in a direction towards the door frame. The upper and lower mounting holes of the strike plate each have a threaded fastener 19 extending therethrough into the door frame to couple the strike plate to the door frame. Each of the threaded fasteners has a generally frusta-conical head portion 20 with a slot 21 for engaging a tool such as a screwdriver for rotating the respective threaded fastener.

The system also includes a substantially planar oblong cover plate 22 having substantially planar inwards and outwards faces 23,24, a pair of opposite rounded ends 25,26 and a pair of substantially parallel sides 27,28 extending between the ends of the cover plate. The cover plate may comprise a rigid metal or a rigid plastic material. The ends of the cover plate are rounded to eliminate corners that may catch on the strike plate or door frame when the cover plate is pivoted during use. In one embodiment, the ends of the cover plate have equal radii of curvatures.

The cover plate has a pivot hole 29 extending therethrough between the faces of the cover plate. The pivot hole has a generally circular outer periphery. The pivot hole is positioned towards a first of the ends of the cover plate. In one embodiment, the pivot hole may be spaced apart about ½ inch from the first end of the cover plate to prevent a crack from forming between the pivot hole and the first end. The pivot hole of the cover plate may also be equidistantly positioned between the side edges of the cover plate.

As best illustrated in FIG. 4, in one embodiment, the pivot hole may have a generally frusta-conical flared end 30 positioned adjacent the outwards face of the cover plate and tapering towards the inwards face of cover plate.

In an optional embodiment, a generally cylindrical tubular sleeve 31 may be disposed in the pivot hole of the cover plate between the inwards face of the cover plate and the flared end of the pivot hole to help permit free rotation of the sleeve in the pivot hole about a central axis of the sleeve.

The cover plate is positioned adjacent the strike plate so that the inwards face of the cover plate faces the strike plate. The threaded fastener of the upper mounting hole of the strike plate is extended through the pivot hole and the sleeve of the cover plate to pivotally couple the cover plate to the strike plate. The flared end of the pivot hole of the cover plate receives therein the head portion of the threaded fastener of the upper mounting hole.

The thickness of the cover plate should be sufficiently thin enough to permit closing of the door uninhibited by the cover plate. In an illustrative embodiment, the cover plate may have a thickness defined between the faces of the cover plate of about 0.04 inch, a length defined between the ends of the cover plate of about 6 inches and a width defined between the sides of the cover plate of about 1 inch.

Figure 2:
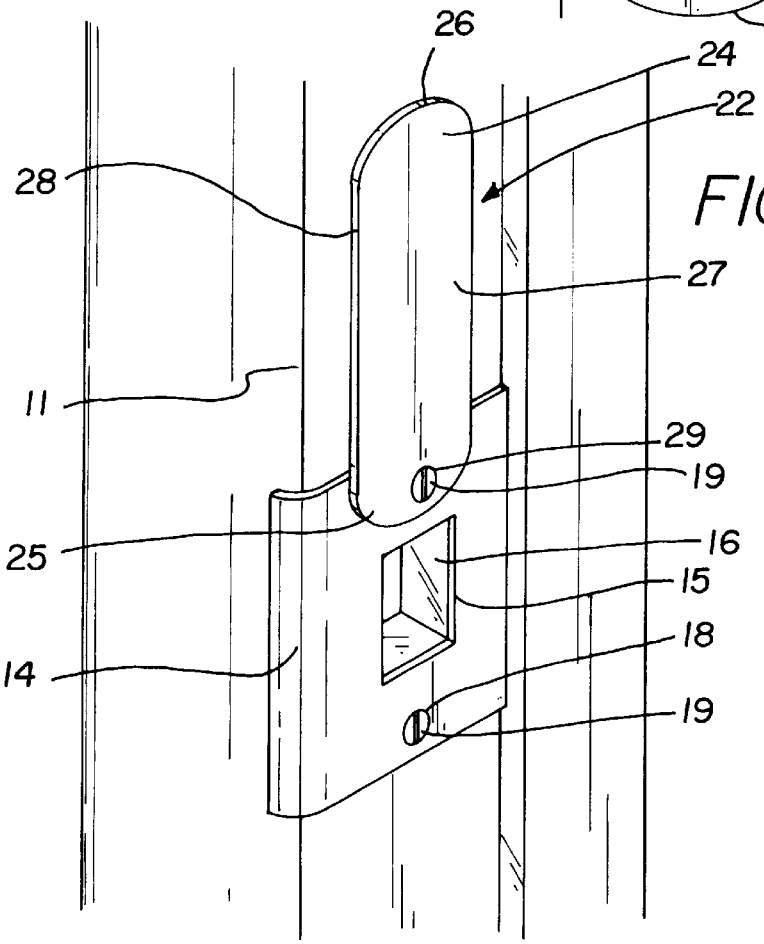
FIG. 2 is a schematic perspective view of the present invention with the cover plate in the raised uncovered position.
Figure 3:
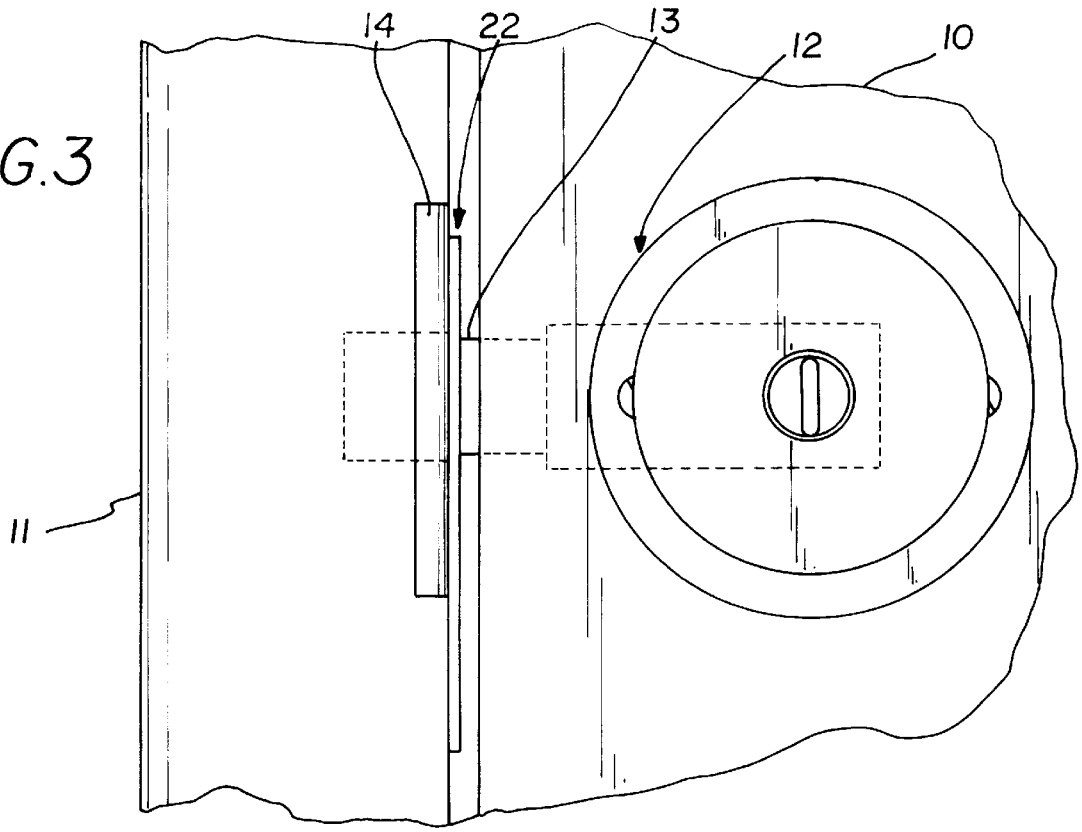
FIG. 3 is a schematic plan view of the present invention as seen from a vantage perpendicular to that of FIG. 1 with the cover plate in the lowered covered position to prevent the door lock bolt from engaging the strike plate.

In use, the cover plate is pivotable about the threaded fastener of the upper mounting hole between a lowered covered position (FIG. 1) and a raised uncovered position (FIG. 2). A user may pivot the cover plate between the lowered covered position and the raised uncovered position with their fingers.

With reference to FIG. 1, when the cover plate is positioned in the lower covered position, a second of the ends of the cover plate is positioned below the first end of the cover plate. In the lower covered position, the cover plate covers the central hole of the strike plate to prevent the bolt of the door lock from is inserted into the central hole of the strike plate.

With reference to FIG. 2, the second end of the cover plate is positioned above the first end of the cover plate when the cover plate is positioned in the raised uncovered position. In this raised uncovered position, the cover plate is positioned above the central hole of the strike plate to expose the central hole to permit insertion of the bolt of the door lock therein to permit engagement of the bolt when the strike plate.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A door lock anti-locking device for preventing locking of a door with a door lock, said door lock anti-locking device comprising:

a door frame having a strike plate coupled thereto;

said strike plate having a generally rectangular central hole therethrough aligned with a corresponding receiver hole of said door jamb for receiving therein the bolt of the door lock when the door is closed;

said strike plate having spaced apart upper and lower mounting holes, said central hole being interposed between said mounting holes of said strike plate;

a cover plate having inwards and outwards faces, a pair of ends and a pair of sides extending between said ends of said cover plate;

said cover plate having a pivot hole extending therethrough between said faces of said cover plate, said pivot hole being positioned closer towards a first of said ends than to a second of said ends of said cover plate; and said pivot hole having a fastener therethrough and into said upper mounting hole of said strike plate to pivotally couple said cover plate to the strike plate.

2. The door lock anti-locking device of claim 1, wherein said ends of said cover plate are rounded and have equal radii of curvatures.

3. The door lock anti-locking device of claim 1, wherein said pivot hole having a generally frusta-conical flared end positioned adjacent said outwards face of said cover plate and tapering towards said inwards face of said cover plate, said flared end being adapted for receiving therein a head portion of the fastener.

4. The door lock anti-locking device of claim 1, wherein a tubular sleeve is disposed in said pivot hole of said cover plate to permit free rotation of said sleeve in said pivot hole about a central axis of said sleeve, said sleeve being adapted for extending the fastener therethrough to help pivoting of said cover plate about the fastener.

5. An anti-locking system, comprising:

a door pivotally coupled to a door frame;

said door having a door lock, said door lock having a retractable bolt outwardly extending from said door;

said door frame having a strike plate coupled thereto;

said strike plate having a generally rectangular central hole therethrough aligned with a corresponding receiver hole said door jamb for receiving therein said bolt of said door lock when said door is closed;

said strike plate having spaced apart upper and lower mounting holes, said central hole being interposed between said mounting holes of said strike plate;

said upper and lower mounting holes of said strike plate each having a generally frusta-conical shaped outer periphery tapering in a direction towards the door frame;

said upper and lower mounting holes of said strike plate each having a threaded fastener extending therethrough into said door frame to couple said strike plate to said door frame;

each of said threaded fasteners having a generally frusta-conical head portion;

said head portions each having a slot for engaging a tool for rotating the respective threaded fastener;

a substantially planar oblong cover plate having substantially planar inwards and outwards faces, a pair of opposite rounded ends and a pair of substantially parallel sides extending between said ends of said cover plate;

said ends of said cover plate having equal radii of curvatures;

said cover plate having a pivot hole extending therethrough between said faces of said cover plate, said pivot hole having a generally circular outer periphery;

said pivot hole being positioned towards a first of said ends of said cover plate;

said pivot hole of said cover plate being equidistantly positioned between said side edges of said cover plate;

said pivot hole having a generally frusta-conical flared end positioned adjacent said outwards face of said cover plate and tapering towards said inwards face of cover plate;

wherein a generally cylindrical tubular sleeve is disposed in said pivot hole of said cover plate between said inwards face of said cover plate and said flared end of said pivot hole to permit free rotation of said sleeve in said pivot hole about a central axis of said sleeve;

said cover plate being positioned adjacent said strike plate such that said inwards face of said cover plate faces said strike plate;

said threaded fastener of said upper mounting hole of said strike plate being extended through said pivot hole and said sleeve of said cover plate to pivotally couple said cover plate to said strike plate, said flared end of said pivot hole of said cover plate receiving therein said head portion of said threaded fastener of said upper mounting hole;

said cover plate being pivotable about said threaded fastener of said upper mounting hole between a lowered covered position and a raised uncovered position;

a second of said ends of said cover plate being positioned below said first end of said cover plate when said cover plate is positioned in said lower covered position;

said cover plate covering said central hole of said strike plate when said cover plate is positioned said lower covered position to prevent said bolt of said door lock from being inserted into said central hole of said strike plate;

said second end of said cover plate being positioned above said first end of said cover plate when said cover plate is positioned in said raised uncovered position; and said cover plate being positioned above said central hole of said strike plate when said cover plate is positioned in said raised uncovered position to expose said central hole to permit insertion of said bolt of said door lock therein.

* * * * *